US011654329B1

(12) United States Patent
Koroknyai

(10) Patent No.: US 11,654,329 B1
(45) Date of Patent: May 23, 2023

(54) GLUTE REBUILDING DEVICE

(71) Applicant: Anna Koroknyai, Glendale, CA (US)

(72) Inventor: Anna Koroknyai, Glendale, CA (US)

( * ) Notice: Subject to any disclaimer, the term of this patent is extended or adjusted under 35 U.S.C. 154(b) by 112 days.

(21) Appl. No.: 17/477,405

(22) Filed: Sep. 16, 2021

Related U.S. Application Data

(60) Provisional application No. 63/085,388, filed on Sep. 30, 2020.

(51) Int. Cl.

| | |
|---|---|
| ***A63B 23/04*** | (2006.01) |
| ***A63B 21/055*** | (2006.01) |
| ***A63B 21/16*** | (2006.01) |
| ***A63B 21/04*** | (2006.01) |
| ***A63B 23/035*** | (2006.01) |
| ***A63B 21/00*** | (2006.01) |
| ***A63B 22/20*** | (2006.01) |

(52) U.S. Cl.
CPC ..... *A63B 23/0482* (2013.01); *A63B 21/0442* (2013.01); *A63B 21/0557* (2013.01); *A63B 21/1654* (2013.01); *A63B 21/4033* (2015.10); *A63B 22/20* (2013.01); *A63B 23/03508* (2013.01); *A63B 2225/093* (2013.01)

(58) Field of Classification Search
CPC ..... A63B 23/0482; A63B 21/0442; A63B 21/0557; A63B 21/1654; A63B 21/4033; A63B 22/20; A63B 23/03508; A63B 2225/09
See application file for complete search history.

(56) References Cited

U.S. PATENT DOCUMENTS 3,430,956 A * 3/1969 Borgeas ..... A63B 23/085 482/79
3,787,049 A * 1/1974 Rellinger ..... A63B 23/00 482/142
4,561,649 A * 12/1985 Forsythe ..... A63B 23/08 482/121
4,809,971 A * 3/1989 Goldish ..... A63B 21/1654 482/904
5,645,516 A * 7/1997 Foster ..... A63B 23/085 482/121
5,701,685 A * 12/1997 Pezza ..... A63B 25/10 36/7.8
6,244,992 B1 * 6/2001 James ..... A61H 1/0237 482/79
D473,272 S * 4/2003 Heins ..... D21/685
7,591,763 B1 * 9/2009 Fucci ..... A63B 21/4013 482/52

(Continued)

*Primary Examiner* — Andrew S Lo
(74) *Attorney, Agent, or Firm* — Cislo & Thomas, LLP

(57) ABSTRACT

A glute rebuilding device comprising a main body, at least one slide, and a support. The main body has an upper portion and a lower portion. The upper portion has a top and bottom surface and a first and second end, the second end having a foot rest extending therefrom. The lower portion has a top and bottom surface and a first and second end. The slide is coupled to the bottom surface of the lower portion of the main body. The support is configured for placement between the upper and lower portions of the main body to elevate the upper portion with respect to the lower portion. The second end of the upper portion is pivotally connected to the second end of the lower portion by a hinge, such that the upper portion can move between a flat position, an elevated position, and an unfolded position.

13 Claims, 13 Drawing Sheets

(56) References Cited

U.S. PATENT DOCUMENTS

| | | | | |
|---|---|---|---|---|
| 8,857,906 | B2 * | 10/2014 | Connors | A47C 20/04 297/230.13 |
| 11,577,123 | B1 * | 2/2023 | Saffaie | A63B 23/0482 |
| 11,590,391 | B2 * | 2/2023 | Tarkington | A63B 21/0407 |
| 2007/0219071 | A1 * | 9/2007 | Hamer | A63B 21/4015 482/79 |
| 2011/0105277 | A1 * | 5/2011 | Shauli | A63B 21/1609 482/4 |
| 2011/0208098 | A1 * | 8/2011 | Zaborowski | A61H 1/0237 601/33 |
| 2012/0184412 | A1 * | 7/2012 | Glaner | A63B 21/05 482/30 |
| 2013/0245510 | A1 * | 9/2013 | Zaborowski | A61H 1/0274 601/33 |
| 2014/0128231 | A1 * | 5/2014 | Menaker | A63B 21/4029 482/145 |
| 2016/0236031 | A1 * | 8/2016 | Nouri | A63B 23/03541 |
| 2018/0008857 | A1 * | 1/2018 | Barber | A63B 21/0428 |
| 2019/0022459 | A1 * | 1/2019 | Hoeven | A63B 23/03525 |
| 2019/0076696 | A1 * | 3/2019 | Townsend | A61H 1/0266 |
| 2019/0160322 | A1 * | 5/2019 | McCarthy | A63B 21/4034 |
| 2021/0361999 | A1 * | 11/2021 | Tarkington | A63B 22/16 |
| 2022/0401783 | A1 * | 12/2022 | Choi | A63B 23/03508 |

* cited by examiner

GLUTE REBUILDING DEVICE

CROSS-REFERENCE TO RELATED APPLICATIONS

This application is a United States Non-Provisional Patent Application that claims priority to U.S. Provisional Patent Application No. 63/085,388, titled "Glute Rebuilding Device," filed Sep. 30, 2020, the contents of which are incorporated by reference herein in their entirety.

BACKGROUND

Many individuals have a sedentary lifestyle—commuting several hours a day to their job, sitting at computers or desks for a large part of the day, and watching a large amount of television. Many individuals also have been injured or otherwise have more chronic musculo-skeletal issues that require therapy. A sedentary lifestyle leads to constant compression of the sit bones, lower back, hamstrings and glutes; whereas, other reasons for musculo-skeletal issues may manifest similar symptoms. As a result, serious posture issues and atrophy can develop or exist, which can lead to debilitating and extreme pain, as well as substantially limited mobility. Well-developed glutes and neighboring anatomical areas are the cradle for a strong spine and lower back.

Accordingly, there is a need for a glute rebuilding device to address the issues caused by a sedentary lifestyle, injury, medical condition, or otherwise.

SUMMARY

The invention described herein is directed to a glute rebuilding device having a main body, at least one slide, and a support. The main body has an upper portion and a lower portion. The upper portion has a top surface, a bottom surface, a first end and a second end, and the second end of the upper portion has a foot rest extending therefrom. The lower portion has a top surface, a bottom surface, a first end, and a second end.

The at least one slide is coupled to the bottom surface of the lower portion of the main body.

The support is configured for placement between the upper and lower portions of the main body to elevate the upper portion with respect to the lower portion.

The second end of the upper portion is pivotally connected to the second end of the lower portion by a hinge, such that the upper portion can move between a flat position, at least one elevated position, and an unfolded position.

The second end of the upper portion of the main body can have a loop coupled thereto.

The device can further comprise a resistance band for coupling to the loop.

Optionally, the bottom surface of the upper portion of the main body has a first recess, and the top surface of the lower portion of the main body has a second recess.

The support can comprise an outer portion configured for placement into the second recess in the top surface of the lower portion of the main body, and an inner portion configured for insertion into the outer portion of the support.

Optionally, the support is a wedge having a base that is configured for placement into the second recess in the top surface of the lower portion of the main body, and an edge configured for insertion into the first recess in the bottom surface of the upper portion of the main body.

The slides can be circular.

There can be at least one section of compressible material coupled to the top surface of the upper portion of the main body.

A method of a user using a glute rebuilding device comprises the steps of:

a) sitting on the floor by the user, wherein a first leg is positioned in front of the user, and a second leg, having a thigh and calf, is bent and positioned behind the user b) providing the device;

c) placing the second leg of the user on the top surface of the upper portion of the device, wherein the users foot is resting against the foot rest; and d) pulsing the second leg of the user backwards, wherein the thigh and calf of the second leg are maintained at an approximately 90 degree angle relative to each other.

BRIEF DESCRIPTION OF THE DRAWINGS

These and other features, aspects, and advantages of the present invention will become better understood with regard to the following description, appended claims, and accompanying drawings.

FIG. 109 shows a second step of the method of using the device of FIG. 6A with the resistance band, wherein the user pulses the second leg backwards;

DETAILED DESCRIPTION OF THE INVENTION

Figure 1A:
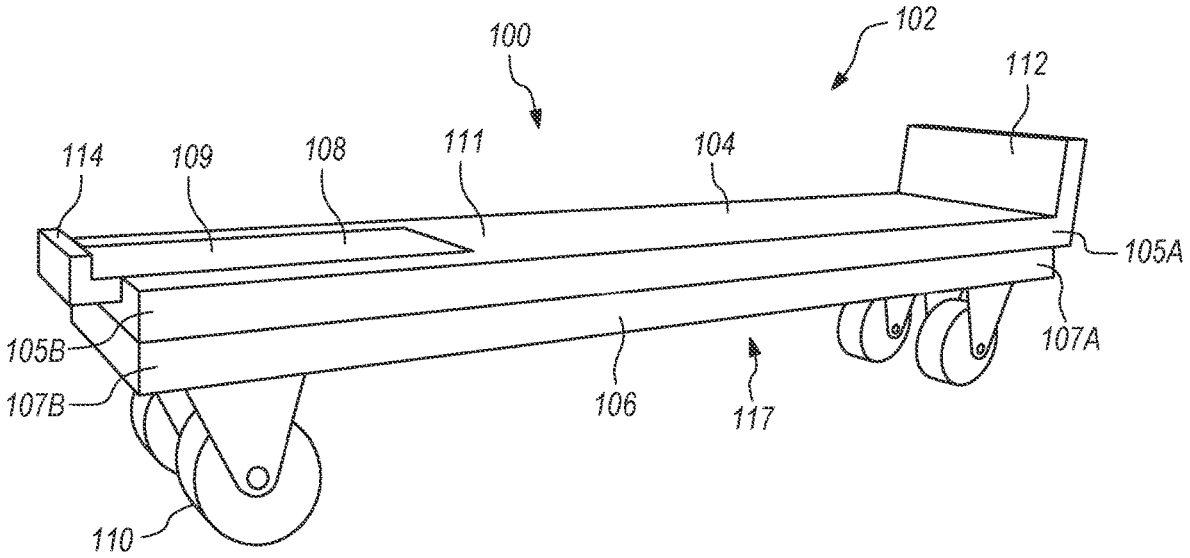
FIG. 1A is a perspective view of a first embodiment of a glute rebuilding device having features of the present invention.

As used herein, the following terms and variations thereof have the meanings given below, unless a different meaning is clearly intended by the context in which such term is used.

The terms "a," "an," and "the" and similar referents used herein are to be construed to cover both the singular and the plural unless their usage in context indicates otherwise.

As used in this disclosure, the term "comprise" and variations of the term, such as "comprising" and "comprises," are not intended to exclude other additives, components, integers ingredients or steps.

All dimensions specified in this disclosure are by way of example only and are not intended to be limiting. Further, the proportions shown in these Figures are not necessarily to scale. As will be understood by those with skill in the art with reference to this disclosure, the actual dimensions and proportions of any system, any device or part of a device disclosed in this disclosure will be determined by its intended use.

The detailed description set forth below in connection with the appended drawings is intended as a description of presently-preferred embodiments of the invention and is not intended to represent the only forms in which the present invention may be constructed or utilized. The description sets forth the functions and the sequence of steps for using the invention in connection with the illustrated embodiments. It is to be understood, however, that the same or equivalent uses and sequences may be accomplished by different embodiments that are also intended to be encompassed within the spirit and scope of the invention.

Referring now to FIGS. 1 through 4, there is shown a first embodiment of a glute rebuilding device 100 having features of the present invention. The glute rebuilding device 100 comprises a main body 102 having an upper portion 104 and a lower portion 106, an optional sliding knee insert 108 slidable along the upper portion 104, and at least one set of wheels 110 coupled to the lower portion 106 of the main body 102. In the Figures, there are shown two sets of wheels 110. The wheels 110 can be any type of usable wheel such as caster wheels or skateboard wheels, however preferably, the wheels are 59 mm soft cruiser wheels typically used on skateboards that are mounted to the lower portion 106 using heavy-duty aluminum trucks. Optionally, instead of wheels 110, at least one rollers could be used, or a pair of runners or slides if greater resistance in sliding is desired. Runners are the slides that a snow sled slides upon. The slides are shown in FIGS. 5 through 10, depicting a second embodiment of the glute rebuilding device 200 which is discussed in greater detail below.

The upper portion 104 has a top surface 111, a bottom surface 113, and two opposed ends, a first end 105A and a second end 105B, and the lower portion 106 has a top surface 115, a bottom surface 117, and two opposed ends 107A, 107B. The top surface 111 of the first end 105A of the upper portion 104 has a foot rest 112 that extends vertically away from the first end 105A of the upper portion 104. The foot rest 112 is a sturdy wall against which the bottom of the user's foot is placed. Optionally, the foot rest 112 is permanently coupled to the upper portion 104. Optionally, the foot rest 112 can have a compressible or soft material coupled thereto for added comfort against the user's foot.

Figure 1B:
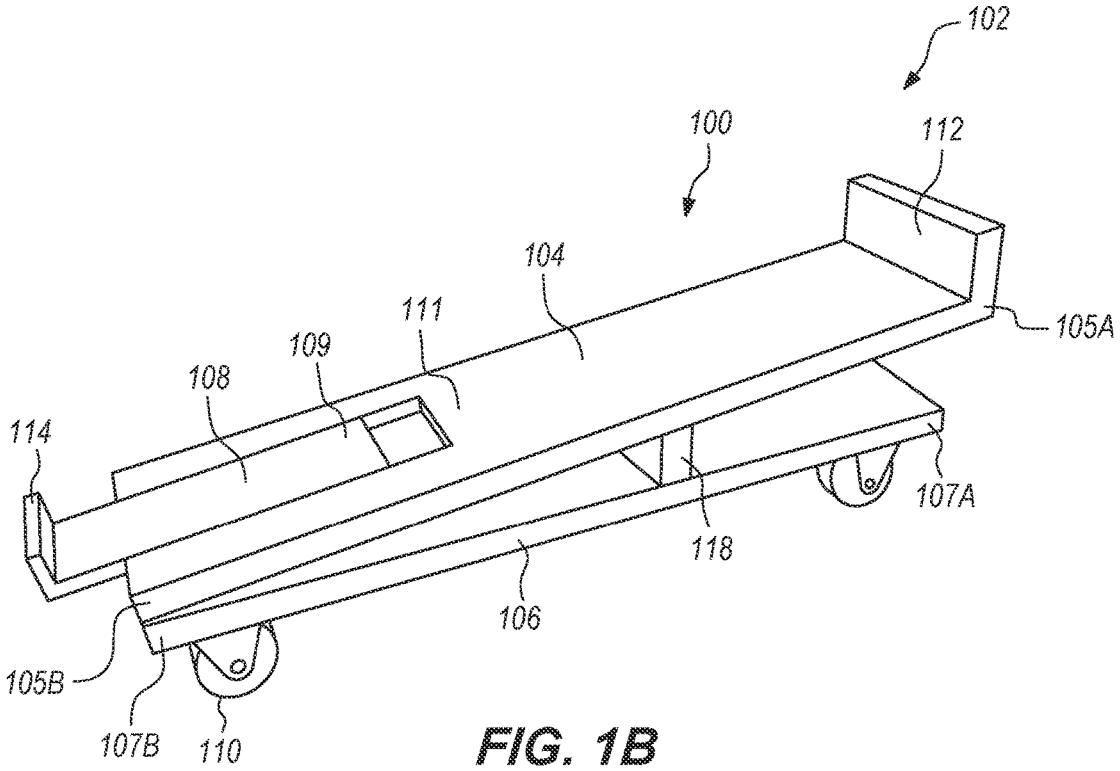
FIG. 1B is an additional perspective view of the glute rebuilding device of FIG. 1A, wherein an upper portion the device is in an elevated position.

As noted above, the second end 105B of the upper portion 104 has the slidable insert 108, and the insert 108 is optional. If the device 100 does have the insert 108, the insert 108 is shaped like an "L" that is recessed into the upper portion 104 so that a top surface 109 of the insert 108 is flush with the top surface 111 of the upper portion 104. The insert 108 is shaped such that the "bottom" of the L forms a knee rest 114 that extends vertically from the remainder of the insert 108. As noted above, the insert 108 is slidable along the upper portion 104 of the device 100 so that a user can adjust the amount of extension of the insert 108, thereby adjusting the distance between the foot rest 112 and knee rest 114. FIG. 1A shows the insert 108 fully retracted into the upper portion 104, and FIG. 1B shows one possible extension position of the slidable insert 108. Optionally, a lower surface of the insert 108 can comprise a series of notches that selectively engage with a ridge or lip in the recess in the upper portion 104, so that the length of extension of the insert 108 can be adjusted and when the desired length is selected, the inset 108 can be securely retained into position when in use.

Figure 5A:
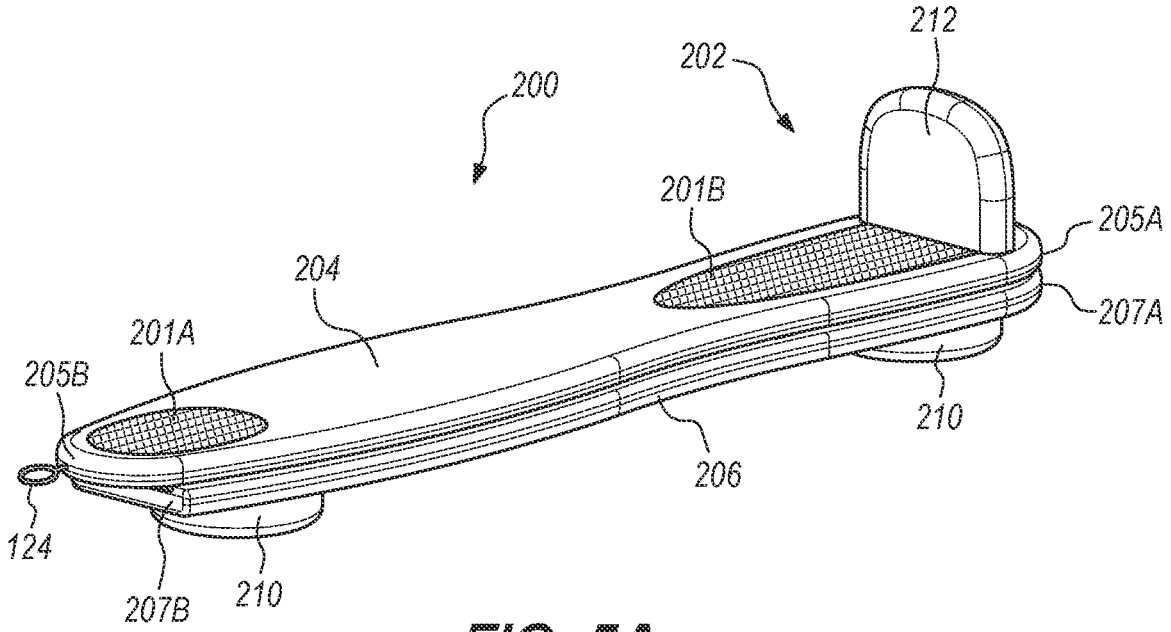
FIG. 5A is a perspective view of a second embodiment of a glute rebuilding device having features of the present invention.
Figure 5B:
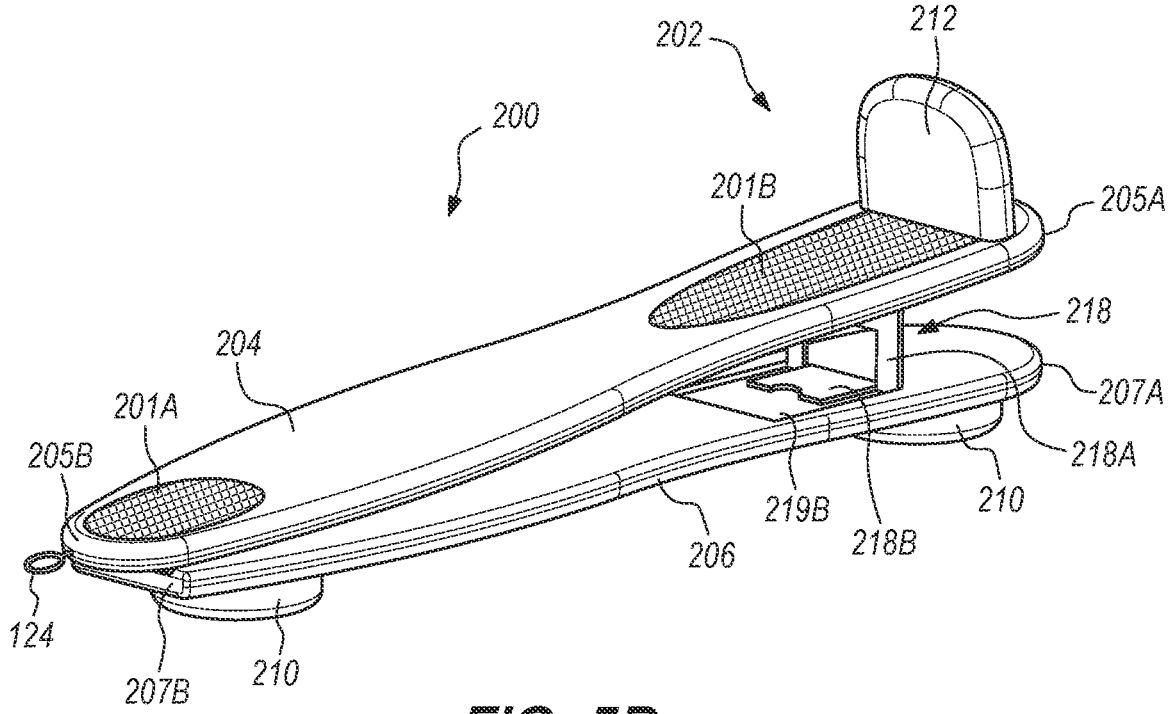
FIG. 5B is an additional perspective view of the glute rebuilding device of FIG. 5A, wherein an upper portion the device is in an elevated position.

As the user's leg is placed on the upper portion 104, between the foot rest 112 and the knee rest 114, the distance between the foot rest 112 and the knee rest 114 should approximately match the length of the user's lower leg. The lower leg is defined as the part of the user's leg that includes the knee and extends through to the bottom of the foot. Optionally, the upper portion 104 of the device 100, proximate the knee rest 114, can have a compressible or soft material 201 coupled thereto for added comfort against the user's knee. This is shown in FIGS. 5A and 5B.

Figure 2:
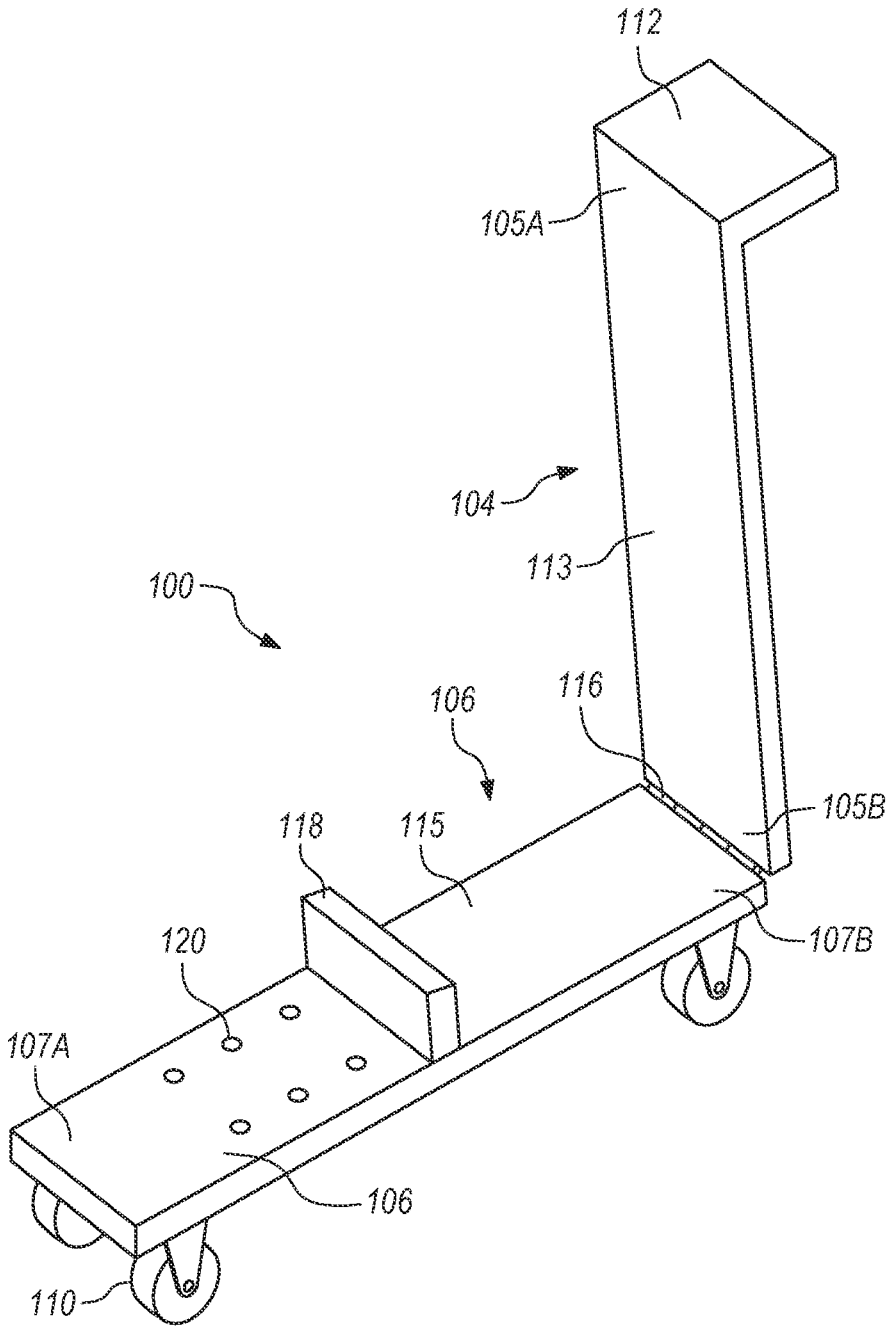
FIG. 2 is an additional perspective view of the device of FIG. 1, wherein the upper portion of the device has been pivoted away from a lower portion of the device to an unfolded position, showing details of an adjustable support that can be removably positioned between the upper portion and the lower portion the device to achieve a desired incline.

The second end 105B of the upper portion 104 that has the insert 108 is also coupled to the second end 107B of the lower portion 106 by a hinge 116. This is best seen in FIG. 2. The upper portion 104 has three main positions: a flat position, shown in FIG. 1A, an elevated position shown in FIG. 1B, and an unfolded position, shown in FIG. 2.

The flat position is where there the upper portion 104 is folded flat against the lower portion 106 so that there is no incline. Here, the lower surface 113 of the upper portion 104 can be in direct contact with the upper surface 115 of the lower portion 106. This is the "beginners" position due to the lack of an incline and provides the lowest level of intensity with respect to the movement/workout performed by the user.

The elevated position shown in FIG. 1B can comprise a plurality of different incline angles depending on the user's desire (in some instances as directed by a physical therapist, physical trainer, or other similar professional). The greater the incline angle, the greater the intensity of the workout on the user's glutes. The different incline angles may be achieved through the use of an adjustable support 118 that can be removably positioned between the upper portion 104 and the lower portion 106 of the device 100 to achieve the desired incline of the upper portion 104. The support 118 is a sturdy piece of material, either solid or hollow, that can withstand the weight of the user's leg on the upper portion 104. Optionally, the support 118 can be in the form of two separate supports 118 that align The support 118 is best seen in FIG. 2, where the upper portion 104 of the device 100 has been pivoted away from the lower portion 106 of the device 100 to the unfolded position. The unfolded position is used when the user wants to adjust the incline angle of the upper portion 104 relative to the lower portion 106.

The lower portion 106 comprises a plurality of holes 120 configured in two parallel rows that form different mounting positions for the support 118. The support 118 has a pair of pegs that extend from a bottom surface of the support 118, and the pegs are positioned for insertion into a pair of holes 120. Depending on the placement of the support 118, the incline angle can be increased, decreased, or alternatively, removed altogether if the support 118 is not used. Optionally, the support 118 can be in the form of two separate supports 118, where one support 118 is placed in one of holes 120 in the first row and the other support 118 is placed in another hole 120 in the second row.

Referring now to FIGS. 5 through 10, there is shown a second embodiment of my glute building device 200. The structure of the second embodiment 200 is substantially similar to the first embodiment 100, but with a few differences. The device 200 has a main body 202 with an upper portion 204 and a lower portion 206, and there is at least one slide 210 coupled to the lower portion 206 of the main body 202. Optionally, the device 200 has a pair of slides 210, as shown in the Figures.

Figure 8A:
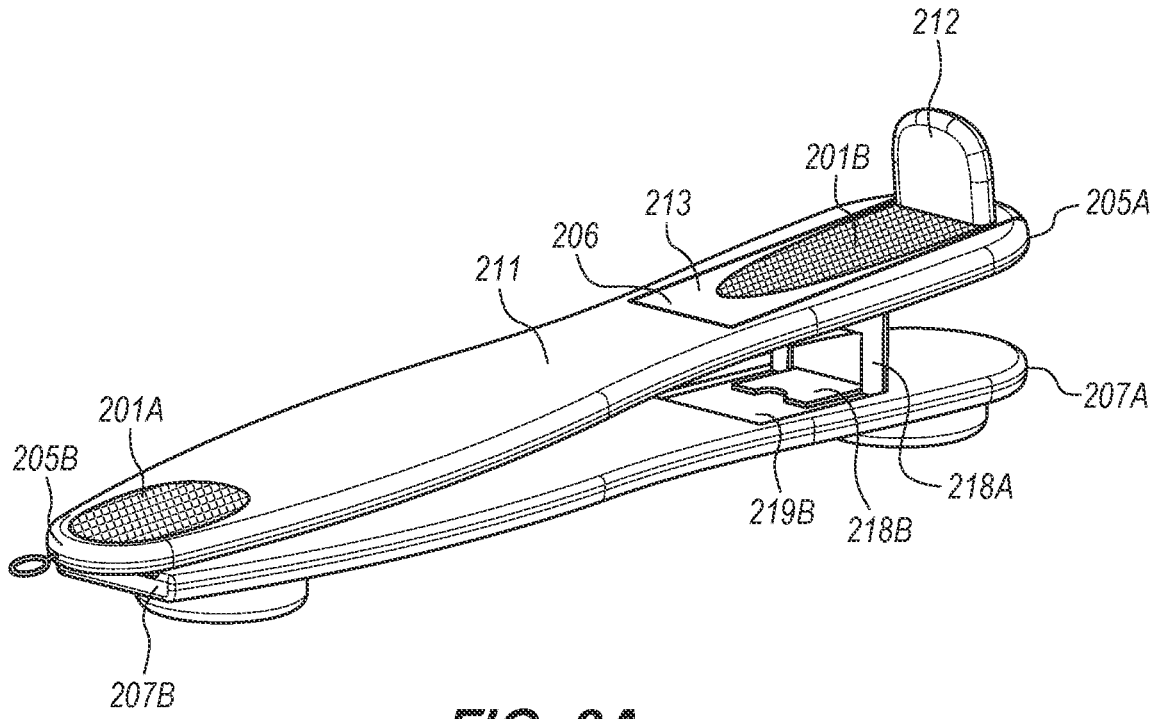
FIG. 8A is an additional perspective view of the glute rebuilding device of FIG. 6A, wherein a sliding foot rest is shown in a recessed position.
Figure 8B:
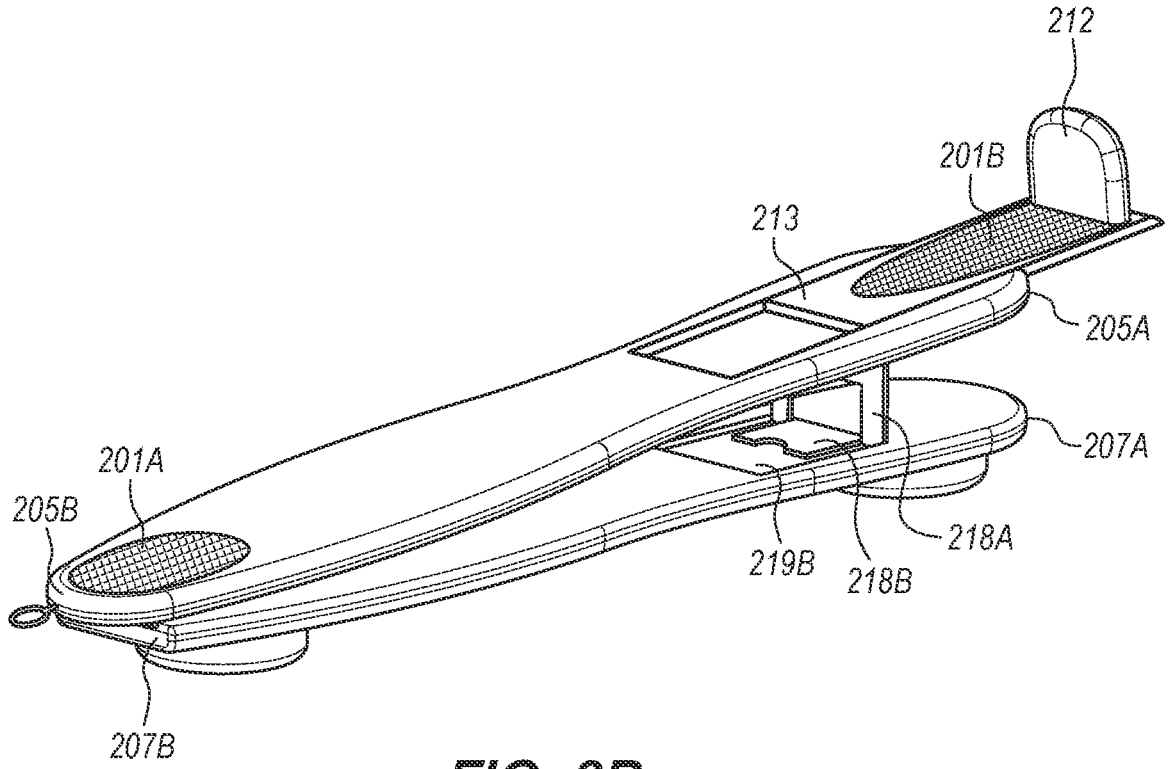
FIG. 8B is an additional perspective view of the glute rebuilding device of FIG. 8B, wherein the sliding foot rest is shown n an extended position.

The upper portion 204 has a top surface 211, a bottom surface 213, and two opposed ends, a first end 205A and a second end 205B, and the lower portion 206 has a top surface 215, a bottom surface 217, and two opposed ends, a first end 207A and a second end 207B. The top surface 213 of the first end 205A of the upper portion 204 has a foot rest 212 that extends vertically away from the first end 205A of the upper portion 204. As shown in FIGS. 5 and 6, the foot rest 212 can either be permanently coupled to the upper portion 204, or, as shown in FIGS. 8A and 8B, the foot rest 212 can be coupled to a slidable insert 213 that makes the foot rest 212 adjustable. Like the knee rest insert 108 in the first embodiment, the foot rest insert 213 is shaped like an "L" that is recessed into the upper portion 204 so that a top surface 209 of the insert 213 is flush with the top surface 211 of the upper portion 204. The insert 213 is shaped such that the "bottom" of the L is the foot rest 212 that extends vertically from the insert 213. As noted above, the insert 213 (and therefore foot rest 212) is slidable along the upper portion 204 of the device 200 so that a user can adjust the amount of extension of the insert 213, thereby adjusting the distance between the foot rest 212 and the second end 205B of the upper portion 204 of the device 200. FIG. 8A shows the insert 213 fully retracted into the upper portion 204, and FIG. 8B shows one possible extension position of the slidable insert 213. Optionally, a lower surface of the insert 213 can comprise a series of notches that selectively engage with a ridge or lip in the recess in the upper portion 204, so that the length of extension of the insert 213 can be adjusted and when the desired length is selected, the inset 213 can be securely retained into position when in use.

Along the top surface 213 of the upper portion 204 there can be at least one section of compressible or soft material 201 coupled thereto for added comfort against the user's knee and ankle. Optionally, there can be two sections of material 201A and 201B.

Figure 6A:
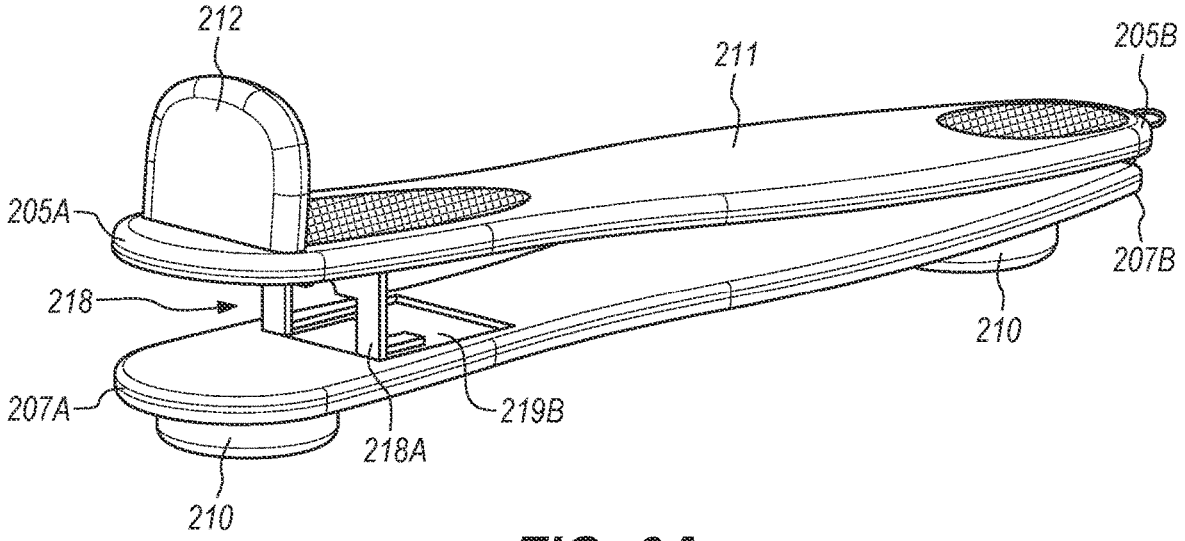
FIG. 6A is an additional perspective view of the glute rebuilding device of FIG. 5A, wherein the device is rotated to better show the adjustable support that is used to elevate the upper portion of the device, wherein the upper portion is in a first elevated position.
Figure 6B:
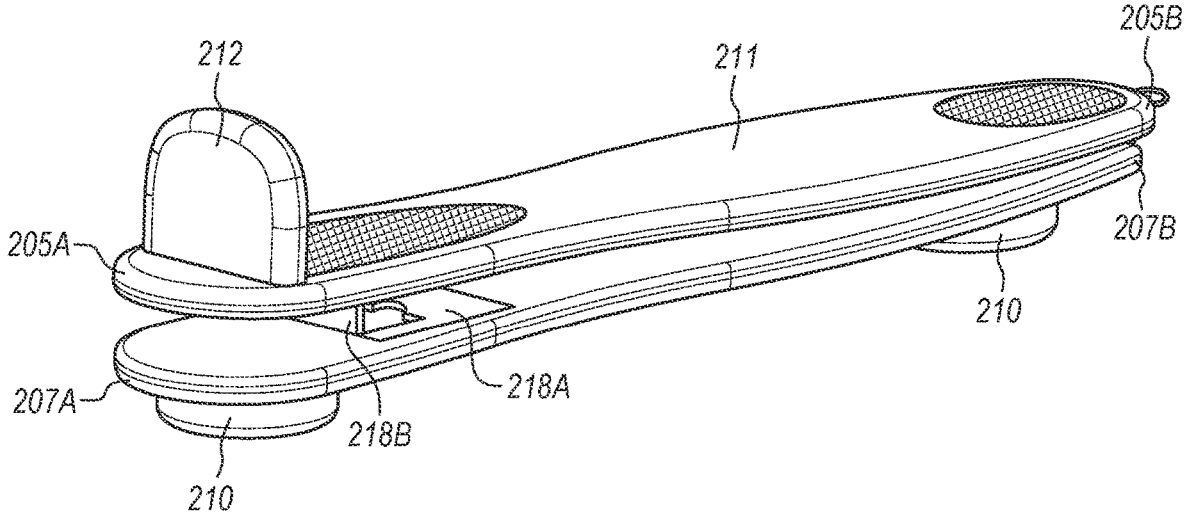
FIG. 6B is an additional perspective view of the glute rebuilding device of FIG. 5A, wherein the adjustable support has been adjusted to position the upper portion in a second elevated position.
Figure 7:
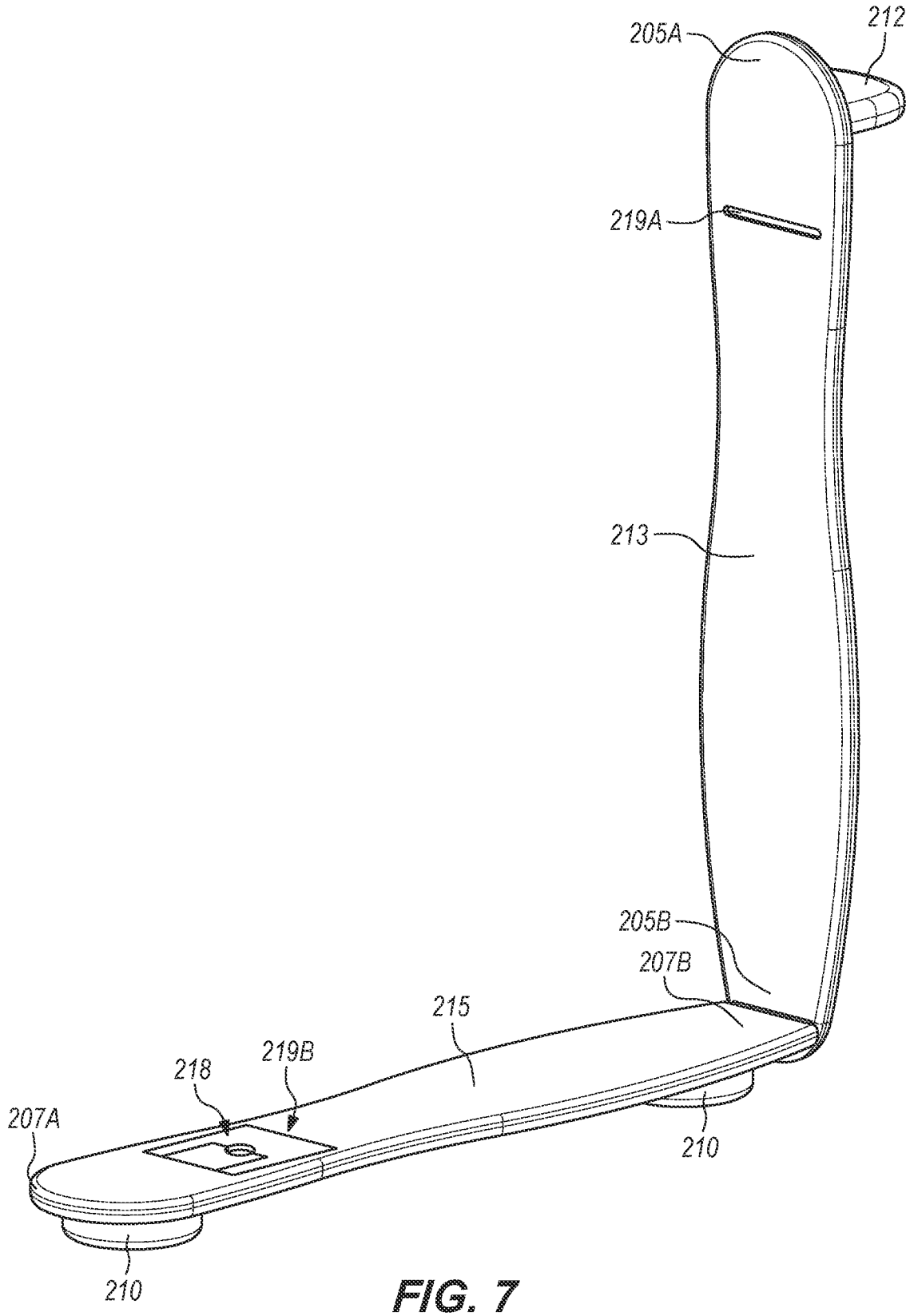
FIG. 7 is an additional perspective view of the device of FIG. 5A, wherein the upper portion of the device has been pivoted away from a lower portion of the device to an unfolded position, showing details of an adjustable support that positioned between the upper portion and the lower portion the device to achieve a desired incline.

The second embodiment 200 also has three main positions: a flat position shown in FIG. 5A, an elevated position, shown in FIGS. 5B, 6A, 6B, and an unfolded position, shown in FIG. 7.

Just like the first embodiment 100, the elevated position (FIGS. 5B, 6A, and 6B) of the second embodiment 200 can comprise a plurality of different incline angles depending on the user's desire. The different incline angles may be achieved through the use of an adjustable support 218 that can be removably positioned between the upper portion 204 having a first recess 219A in its bottom surface 213, and the lower portion 206 having a second recess 219B in its top surface 215 to achieve the desired incline of the upper portion 204.

The support 218 can comprise an outer portion 218A and an inner portion 218B, wherein the inner portion 218B is configured for insertion into the outer portion 218A of the support 218. The outer portion 218A is larger than the inner portion 218B, such that use of the outer portion 218A creates a greater incline than use of the inner portion 218B. This can be seen in FIGS. 6A and 6B, wherein in FIG. 6A, the outer portion 218A is used and in FIG. 6B, the inner portion 218B is used. The incline in FIG. 6A is greater than the incline in FIG. 6B.

First recess 219A is configured to receive a portion of the support 218. The second recess 219B is configured to receive both portions of the support 218A, 218B, and to store one or both portions 218A, 218B of the support 218 when not in use. In FIGS. 6A, 8A, and 8B, outer portion 218A is in use (and engaged with first recess 219A) and inner portion 218B is lying within the recess 219B. In FIG. 6B, inner portion 218B is in use (and engaged with first recess 219A) and outer portion 218A is lying within the recess 219B.

Figure 11:
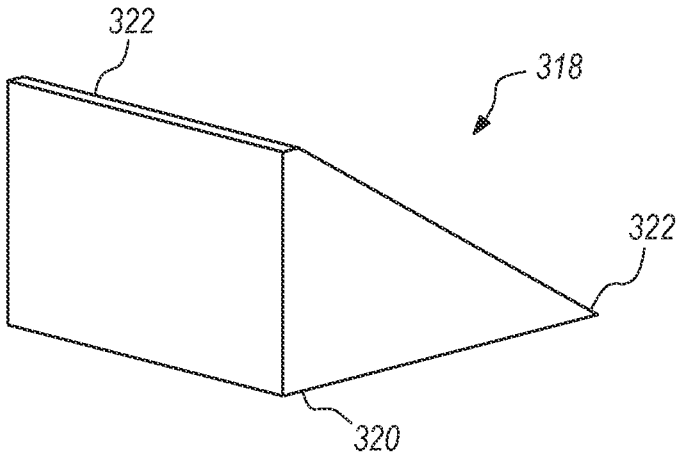
FIG. 11 is a perspective view of a third embodiment of a support.
Figure 12:
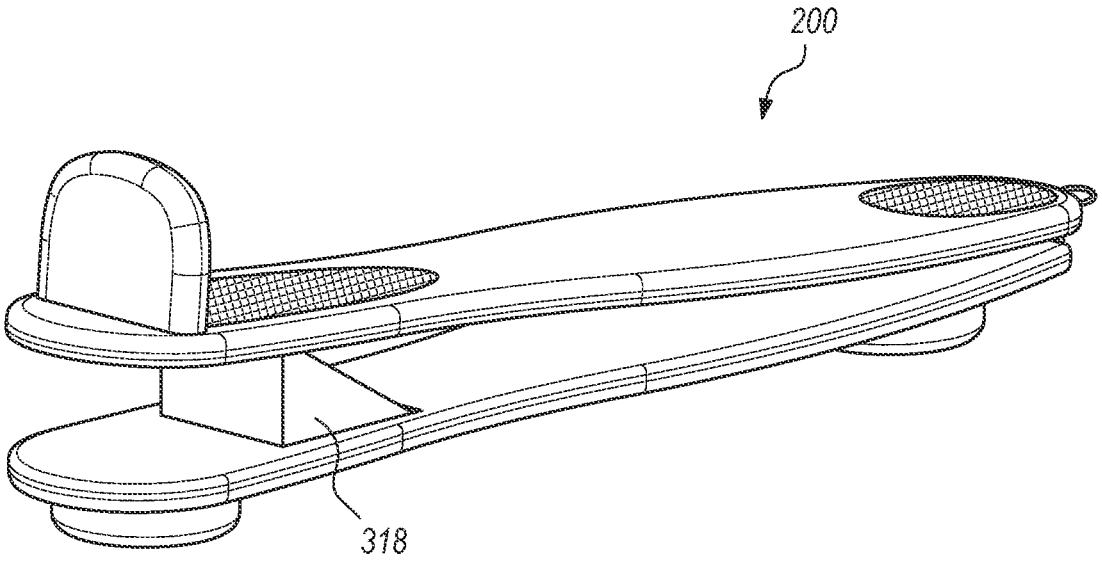
FIG. 12 is a perspective view of the support of FIG. 11 in use in the device of FIG. 5A.

FIGS. 11 and 12 show a preferred support 318 for use with both device embodiments 100, 200. The support 318 is wedge shaped and comprises a base 320 and at least one edge 322. The base 320 of the support 318 is configured for placement into the second recess 219B, and the edge 322 of the support 318 that projects upward is then properly positioned for insertion into the first recess 219A. The support 318 can be a plurality of wedges of various sizes to achieve different angles of incline of the upper portion 204.

Figure 3:
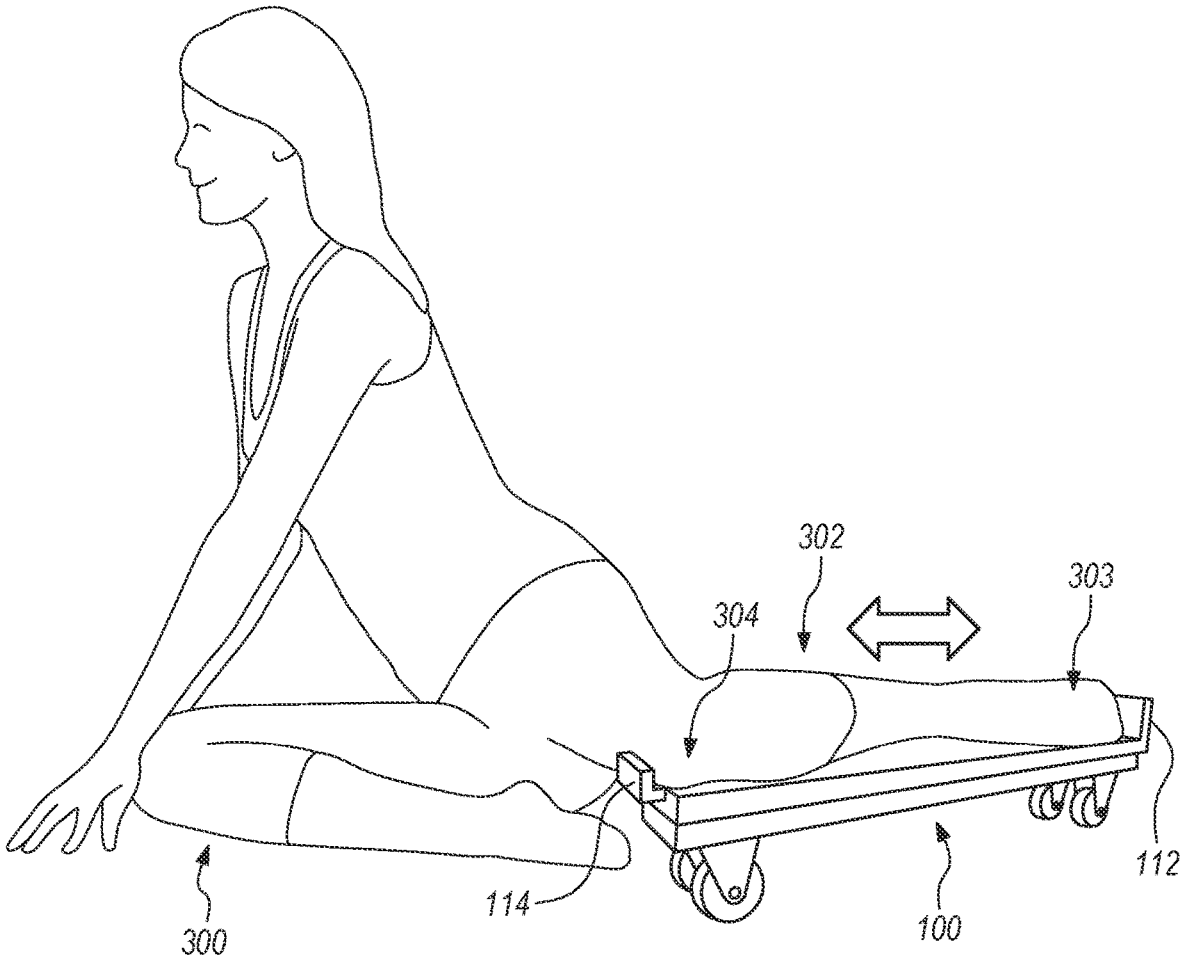
FIG. 3 is a side perspective view of a user using the glute rebuilding device of FIG. 1A, wherein backward pulsing movement of a second leg is shown with a double-sided arrow.

Referring now to FIGS. 3 through 4B and FIGS. 9 through 10B, there is shown use of the two embodiments of the device 100, 200, respectively. The user first sits on the floor, with one leg out in front of the user (front leg 300) and one leg bent back behind the user (rear leg 302). The user's leg that is in front of the user, front leg 300, is resting on the floor and bent at a slight angle to help support the user during use of the device 100, 200. The device 100, 200 is then placed under the lower leg of the user that is bent backwards, the user's rear leg 302. The user's foot 303 is braced against the foot rest 112, 212 and if the device 100, 200 is equipped with a slidable insert 108 as shown in FIG. 3, the knee insert 108 is then slid towards the foot rest 112 until the knee rest 114 touches the user's knee 304.

If the device 100, 200 is equipped with a slidable foot rest 212 as shown in FIGS. 8A, 8B, then the foot rest 212 is slid away from the main body 102, 202 until the users lower leg 302 is properly positioned on the device 100, 200. Proper positioning means the knee 304 and foot 303 of the user's rear leg 302 is comfortably resting on the device 100, 200 as shown in the figures.

Once the device 100, 200 and its various movable/slidable portions/inserts are in place, the user pulses his or her rear leg 302 backwards, optionally by extending and retracting their leg 302, where the wheels 110 (or slides 210) of the device 100, 200 allow the device 100, 200 (and the user's leg 302 resting thereon) to roll/slide backwards and forwards. This pulsing movement facilitates and enables the user to rebuild his or her glutes. This pulsing movement can be repeated with each leg, as many times as necessary, to achieve the desired glute workout.

Figure 9:
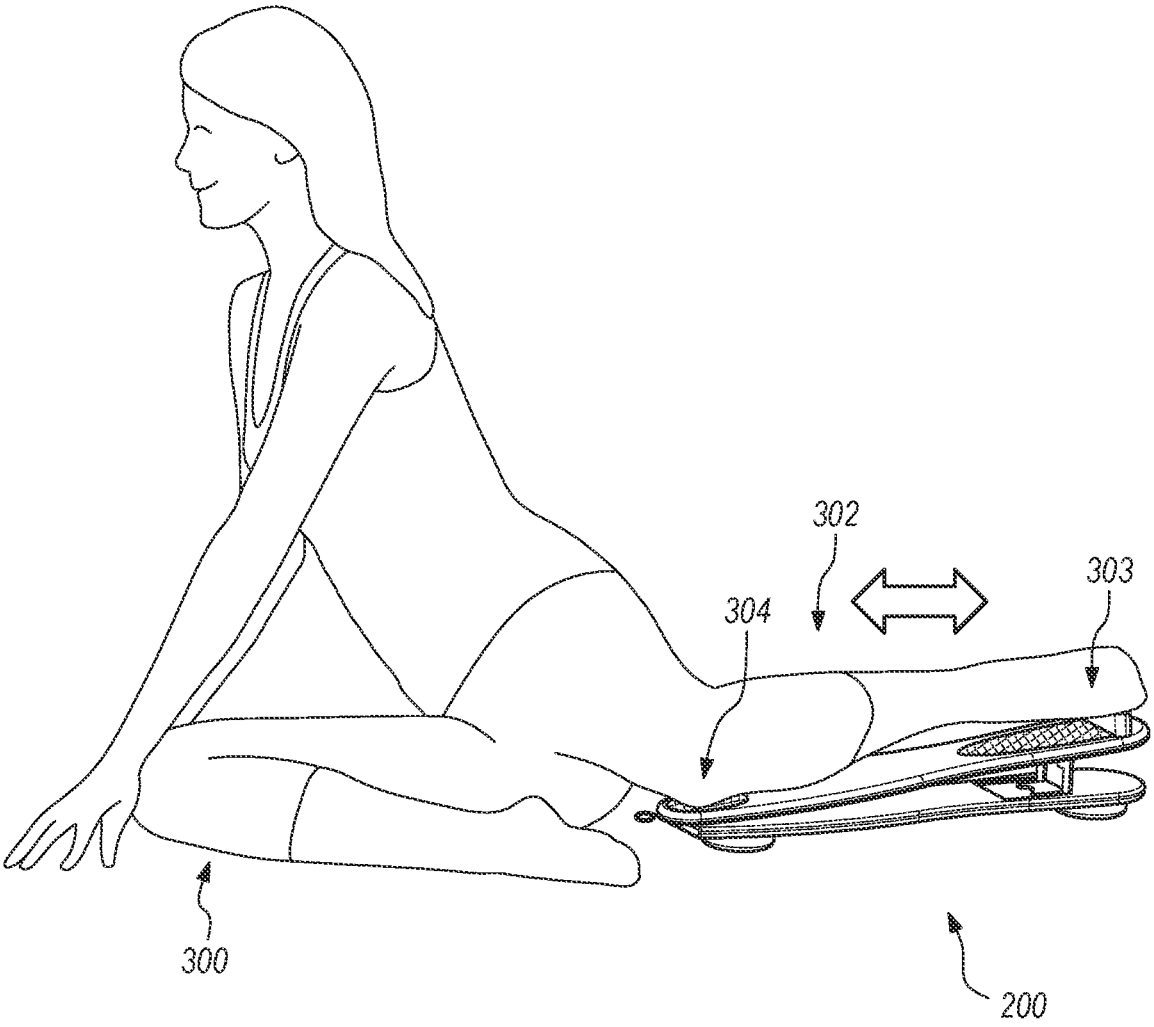
FIG. 9 is a side perspective view of the user using the glute rebuilding device of FIG. 6A, wherein backward pulsing movement of the second leg is shown with a double-sided arrow.

As seen in FIGS. 3 and 9, the user's thigh and calf (lower leg) of the rear leg 302 should be maintained at an approximately 90 degree angle relative to each other, and all leg movements should happen behind the shoulder line of the user (with the shoulder line measured along the user's back, from the back of the user's left shoulder to the back to the user's right shoulder). The user's backward movement of the device 100, 200 is intended to connect the musculature of the buttocks with the lower back and hamstrings, to strengthen the muscles in this region, and to create a lifted, and toned look of the user's glutes.

Figure 4A:
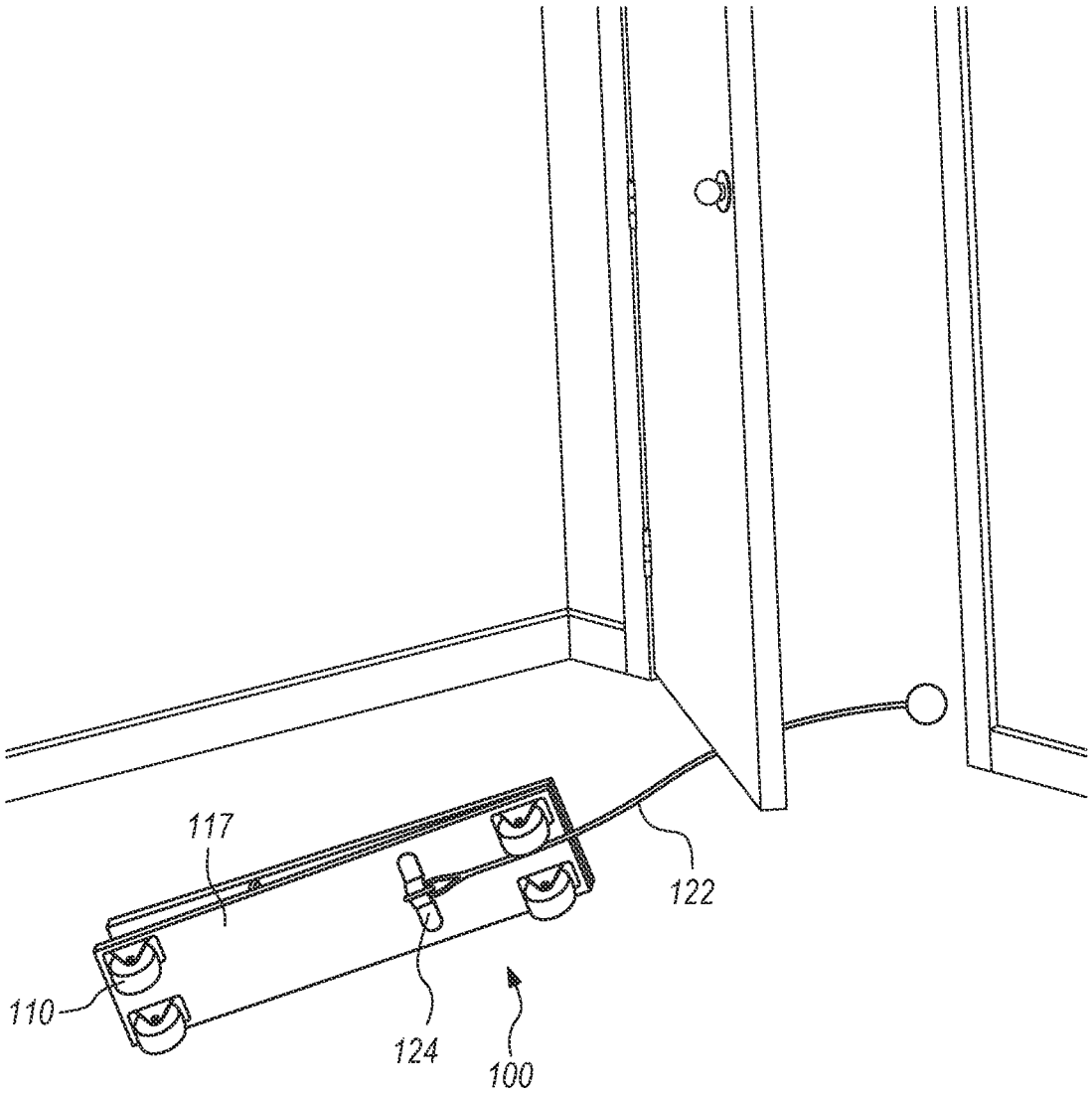
FIG. 4A shows a first step of a method of using the device of FIG. 1A with a resistance band, wherein an end of the band is placed under a door.
Figure 4B:
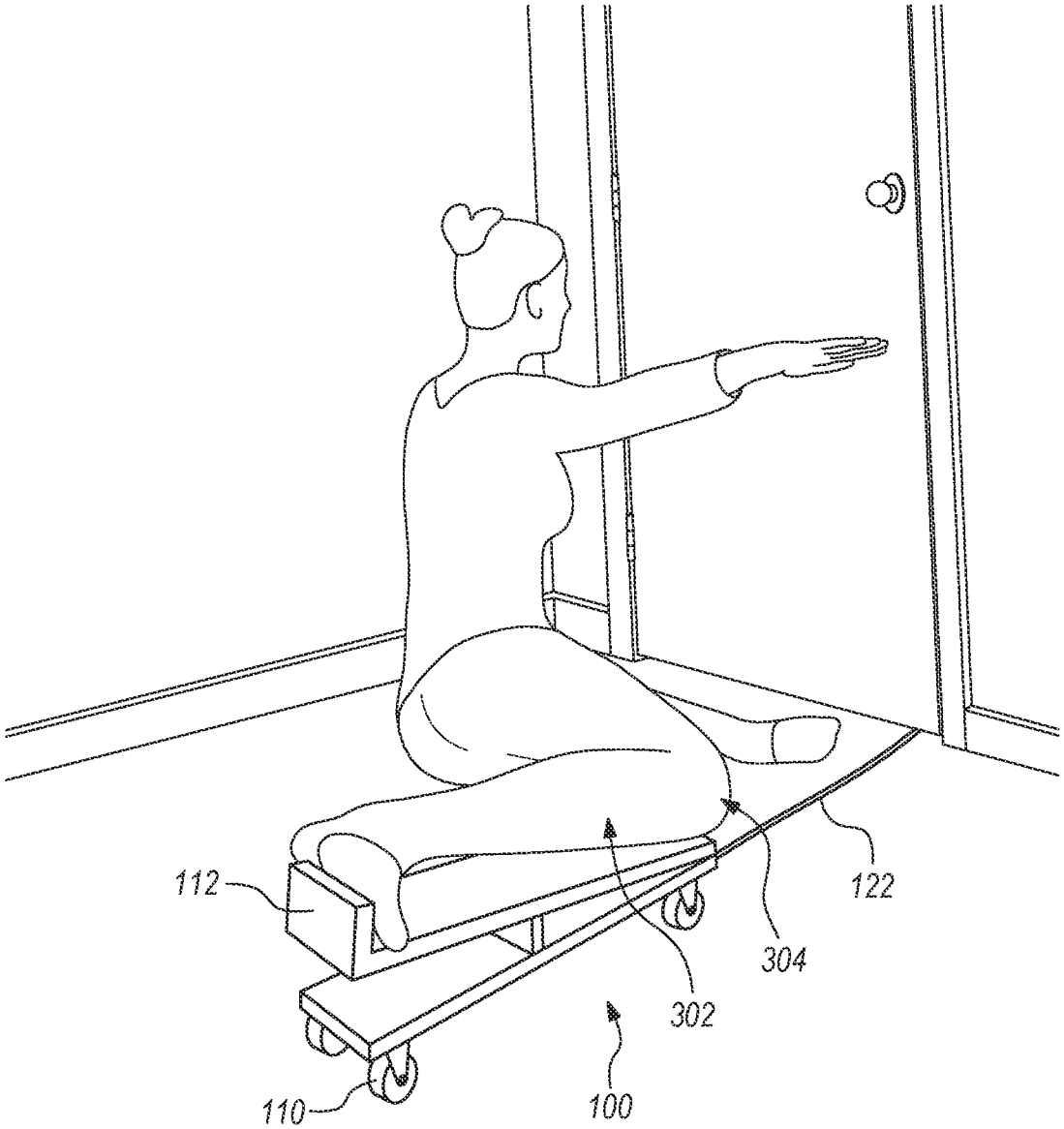
FIG. 4B shows a second step of the method of using the device of FIG. 1A with the resistance band, wherein the user pulses the second leg backwards.
Figure 10A:
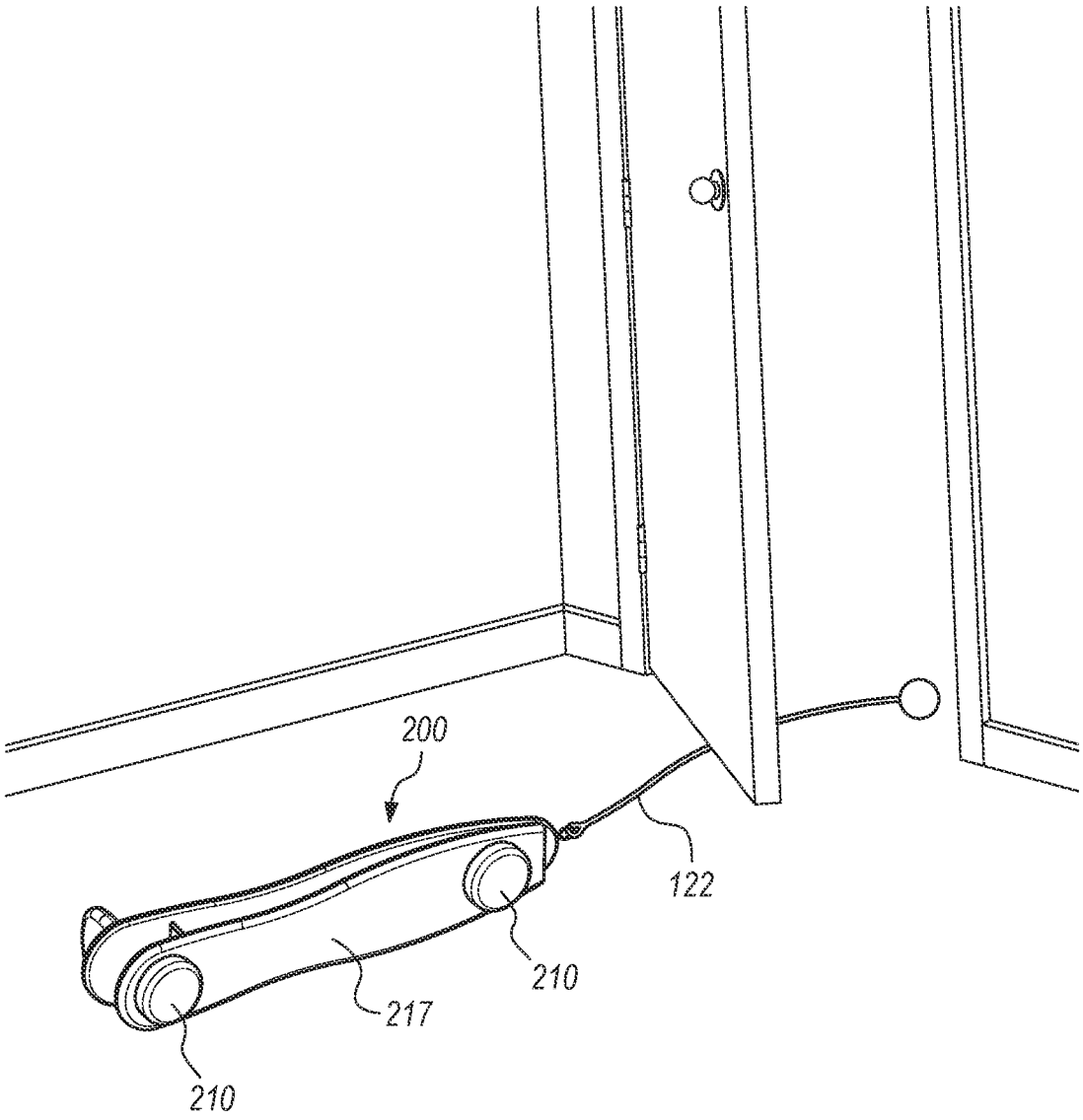
FIG. 10A shows a first step of a method of using the device of FIG. 6A with a resistance band, wherein an end of the band is placed under a door.
Figure 10B:
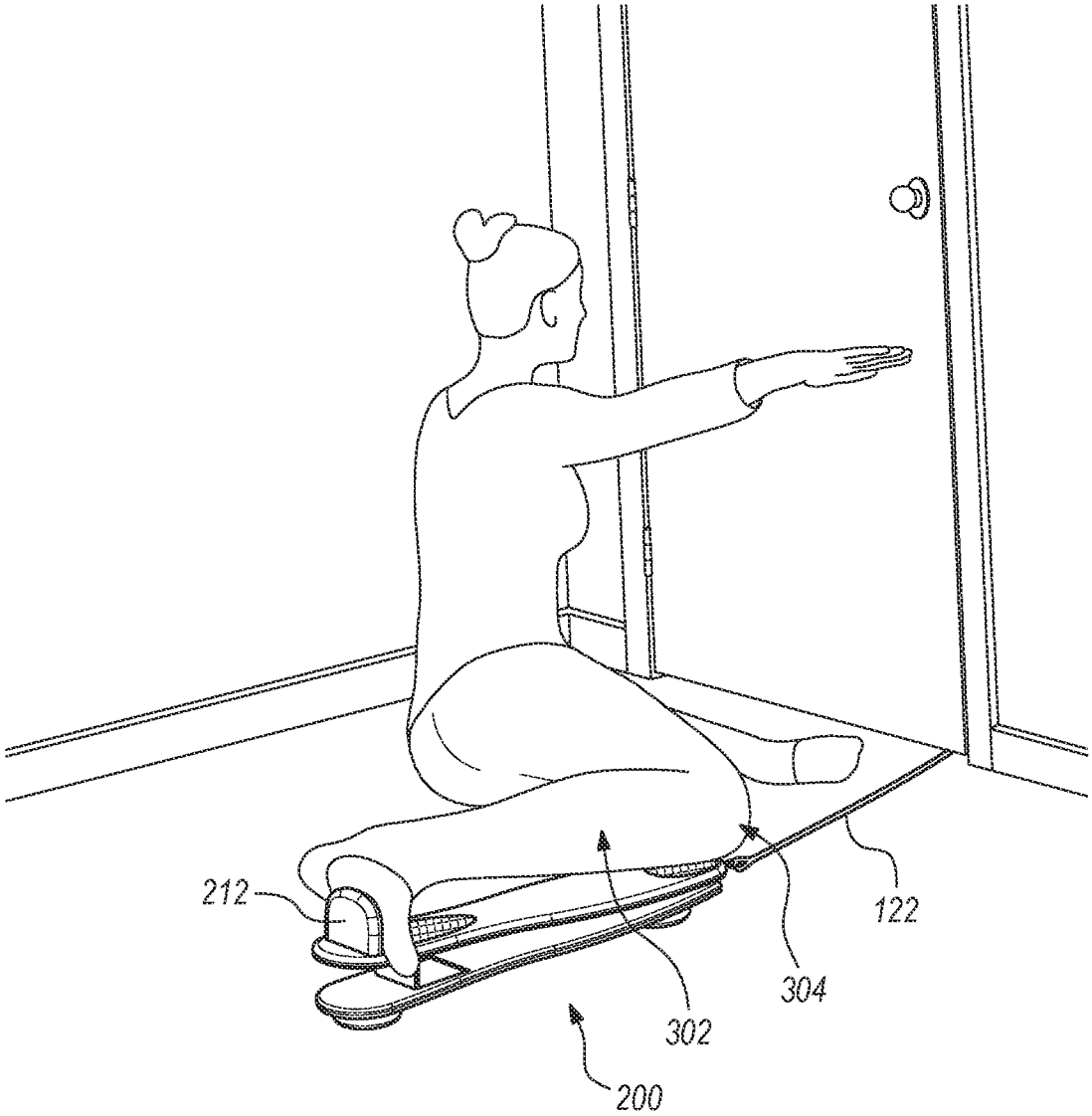

As seen in FIGS. 4A, 4B, 10A, 10B, the device 100, 200 can optionally be used with a resistance band 122 to increase resistance of the device 100, 200 when pulsing it back and forth. Any type of elastic resistance band 122 can be used depending on the amount of resistance the user desires. One end of the band 122 is coupled to the device 100, 200, such as being looped around one of the wheels 110 or trucks or coupled to a loop/hook 124 mounted to main body 102. The loop/hook 124 can optionally be mounted to a lower surface of the lower portion 106 as shown in FIG. 4A, or the loop 124 can be mounted to the second end 205B, 207B of either the upper portion 104, 204, or the lower portion 106, 206 of the device 100, 200, as shown in FIG. 10A. The other end of the band 122 is coupled to a stationary object including but not limited to a weight tower or a door or door jam as shown in the FIGS. 4A and 10A. Once the band 122 is secured to the stationary object, the user rests their rear leg 302 on the device 100, 200 as discussed above, preferably the user's thigh and calf (lower leg) of the rear leg 302 are maintained at a 90 degree angle relative to each other, and begins to pulse their rear leg 302 backward and forward as shown in the figures. The users back remains upright and straight so that the only movement the user makes is the glute muscle pulsing the rear leg 302 back and forth.

Other than the wheels 110, the device 100, 200 can be made from plastic, lightweight metal, wood, or a composite material. Preferably the upper portion 104 of the device 100 utilizes or has attached thereto a non-slip material for easier gripping by the user's lower leg.

Any of the features that are discussed above with respect to the first embodiment 100 can be used on the second embodiment 200, and vice versa, meaning that the various features are not limited to the embodiment of which they were shown and discussed and can all be combined into a single device.

The device 100, 200 has the following advantages:

The device 100, 200 is easy to use and small in size, making it ideal for home use, although the device 100, 200 is not limited to home use.

The device 100, 200 is a simple, but effective way to target the muscles of the gluteal region.

The workout for the user's gluteal muscles can be either increased or decreased in difficulty using the adjustable incline of the upper portion 104, 204 of the device 100, 200. This adjustability is important for progressive strengthening of the muscles, as is typical in therapy or "work out" settings because as the user continues to develop and strengthen the gluteal muscles, the device 100, 200 can continue to be used and not outgrown by the user. Additionally, due to the adjustability, one device 100, 200 can be used by multiple users with differing levels of strength.

The adjustable support 218 of the second embodiment 200 is advantageous because it provides two different levels of incline and when not in use, can be easily stored with/in the device 100, 200 using recess 219. This makes it more difficult to accidentally loose the support 218 when not in use.

Although the present invention has been described in considerable detail with reference to certain preferred embodiments, other embodiments are possible. The steps disclosed for the present methods, for example, are not intended to be limiting nor are they intended to indicate that each step is necessarily essential to the method, but instead are exemplary steps only. Therefore, the scope of the appended claims should not be limited to the description of preferred embodiments contained in this disclosure. All references cited herein are incorporated by reference.

What is claimed is:

1. A glute rebuilding device made from wood and comprising:

a) a main body having:

i) an upper portion having a top surface, a bottom surface, a first end and a second end, wherein there is a first recess in the bottom surface of the upper portion, the first end of the upper portion has a slidable foot rest extending therefrom, and the second end has a loop coupled thereto; and ii) a lower portion having a top surface, a bottom surface, a first end, and a second end, the top surface of the lower portion having a second recess therein;

b) two sections of compressible material coupled to the top surface of the upper portion of the main body;

c) a pair of circular slides coupled to the bottom surface of the lower portion of the main body; and d) a wedge shaped support configured for placement between the upper and lower portions of the main body to elevate the upper portion with respect to the lower portion, the support having:

i) a base that is configured for placement into the second recess in the top surface of the lower portion of the main body; and ii) an edge configured for insertion into the first recess in the bottom surface of the upper portion of the main body;

wherein the second end of the upper portion is pivotally connected to the second end of the lower portion by a hinge, such that the upper portion can move between a flat position, an elevated position using the support, and an unfolded position.

2. The device of claim 1, further comprising a resistance band for coupling to the loop on the main body.

3. The device of claim 1, further comprising a slidable knee insert slidably coupled to the second end of the upper portion of the device.

4. A glutei rebuilding device comprising:

a) a main body having:

i) an upper portion having a top surface, a bottom surface, a first end and a second end, the first end of the second end of the upper portion having a foot rest extending therefrom; and ii) a lower portion having a top surface, a bottom surface, a first end, and a second end;

b) at least one slide coupled to the bottom surface of the lower portion of the main body; and c) a support configured for placement between the upper and lower portions of the main body to elevate the upper portion with respect to the lower portion, wherein the second end of the upper portion is pivotally connected to the second end of the lower portion by a hinge, such that the upper portion can move between a flat position, an elevated position, and an unfolded position.

5. The device of claim 4, wherein the second end of the upper portion of the main body has a loop coupled thereto.

6. The device of claim 5, further comprising a resistance band for coupling to the loop.

7. The device of claim 4, wherein the bottom surface of the upper portion of the main body has a first recess, and the top surface of the lower portion of the main body has a second recess.

8. The device of claim 7, wherein the support comprises:

a) an outer portion configured for placement into the second recess in the top surface of the lower portion of the main body; and b) an inner portion configured for insertion into the outer portion of the support.

9. The device of claim 7, wherein the support is a wedge having:

a) a base that is configured for placement into the second recess in the top surface of the lower portion of the main body; and b) an edge configured for insertion into the first recess in the bottom surface of the upper portion of the main body.

10. The device of claim 4, wherein the slides are circular.

11. The device of claim 4, further comprising at least one section of compressible material coupled to the top surface of the upper portion of the main body.

12. A method of a user using a glute rebuilding device, the method comprising the steps of:

a) sitting on the floor by the user, wherein a first leg is positioned in front of the user, and a second leg, having a thigh and calf, is bent and positioned behind the user;

b) providing the device of claim 1;

c) placing the second leg of the user on the top surface of the upper portion of the device, wherein the user's foot is resting against the foot rest; and pulsing the second leg of the user backwards, wherein the thigh and calf of the second leg are maintained at an approximately 90 degree angle relative to each other.

13. A method of a user using a glute rebuilding device, the method comprising the steps of:

a) sitting on the floor by the user, wherein a first leg is positioned in front of the user, and a second leg, having a thigh and calf, is bent and positioned behind the user;

b) providing a glute rebuilding device comprising:

i) a main body having:

1) an upper portion having a top surface, a bottom surface, a first end and a second end, the first end of the upper portion having a foot rest extending therefrom; and 2) a lower portion having a top surface, a bottom surface, a first end, and a second end;

ii) a pair of slides coupled to the bottom surface of the lower portion of the main body; and iii) a support configured for placement between the bottom surface of the upper portion and the top surface of the lower portion of the main body to elevate the upper portion with respect to the lower portion;

wherein the second end of the upper portion is pivotally connected to the second end of the lower portion by a hinge, such that the upper portion can move between a flat position, an elevated position, and an unfolded position;

c) placing the second leg of the user on top of the upper surface of the upper portion of the device, wherein the user's foot is resting against the foot rest; and d) pulsing the second leg of the user backwards, wherein the thigh and calf of the second leg are maintained at an approximately 90 degree angle relative to each other.

* * * * *